US006691900B1

(12) United States Patent
Cermak, III

(10) Patent No.: US 6,691,900 B1
(45) Date of Patent: Feb. 17, 2004

(54) PLUG FOR REMOVABLY RESEALING A MATERIAL-DISPENSING PLASTIC CONDUIT AND METHOD OF USE

(76) Inventor: William F. Cermak, III, 405 Hunters Way, Fox River Grove, IL (US) 60021

( * ) Notice: Subject to any disclaimer, the term of this patent is extended or adjusted under 35 U.S.C. 154(b) by 0 days.

(21) Appl. No.: 10/384,320

(22) Filed: Mar. 7, 2003

(51) Int. Cl.[7] ..... B67D 47/00

(52) U.S. Cl. ..... 222/552; 222/1; 222/151; 222/554; 222/563

(58) Field of Search ..... 222/1, 149, 151, 222/546, 548, 549, 552, 554, 563

(56) References Cited

U.S. PATENT DOCUMENTS 2,154,549 A * 4/1939 Weissert ..... 222/552
6,223,957 B1 * 5/2001 Hoppe ..... 222/563
6,375,044 B1 * 4/2002 Knestout ..... 222/151
6,375,051 B1 4/2002 Iverson
6,481,597 B1 11/2002 Cermak, III

* cited by examiner

*Primary Examiner*—J Casimer Jacyna
(74) *Attorney, Agent, or Firm*—Edward Gray

(57) ABSTRACT

A plug for removably resealing an aperture in a soft plastic dispensing conduit of a container of material. The plug includes a handle-like upper portion, and a conically tapering lower portion with contiguous scoring edges each having a leading and a trailing surface which form a sharp circumferential point. By firmly inserting the plug into the aperture and then screwing it in, one or several points score a segment of the conduit interior surface, proximate to the aperture, forming grooves. Meshing of edge points and grooves create an air-tight seal. The aperture, reopened by unscrewing the plug, can be repetitively resealed because the scoring edges track within the preformed grooves.

12 Claims, 4 Drawing Sheets

PLUG FOR REMOVABLY RESEALING A MATERIAL-DISPENSING PLASTIC CONDUIT AND METHOD OF USE

BACKGROUND OF THE INVENTION

1. Field of the Invention

This invention relates to closures for sealing material-dispensing conduits such as tubing, nozzles, hoses and the like, and more particularly to a multi-purpose plug for removably resealing, to prevent leakage and hardening, the end of a straw-like plastic tube such as is commonly used to dispense sealant from a can, the tapered nozzle of a cartridge or squeeze tube such as is typically used to dispense adhesive sealant or caulking, or the circular aperture of a squeeze tube such as is used for glue or pipe thread compound.

2. Description of the Related Art

Foam sealants, which expand to take the shape of cracks and voids and then cure to provide a hardened insulating material, typically are sold in pressurized cans having a trigger or similar dispensing mechanism to open an aperture therein releasing the polyurethane- or latex-based foam. Frequently, a length of straw-like plastic tubing, i.e., a tube having a small, circular cross-section bore, is packaged with a can. Inserted into the mechanism, the tube provides a means of aiming and dispensing the sealant. Typically, the material inside the can is liquid, becoming foam as it exits the aperture. Once the can is opened and used, residual material inside the tube begins to harden so that further dispensing eventually becomes impossible, in as little as two hours if the material is polyurethane-based. Usually a replacement tube is not at hand, so the can cannot be used again unless considerable time and effort are spent in removing the clog. Frequently a user will dispose of a can which still contains much material, rather than face the prospect of cleaning out the tube after each use. A removable plug which reliably seals the tubing end would permit storing an opened can for at least three to four weeks and possibly for several months, depending on the material, and using it repetitively until all its material is depleted.

Containers used for packaging adhesive sealant, glue, caulking, pipe thread compound and the like come in several forms. In the "screw-on nozzle" variety a cartridge or squeeze tube comes with a cap and a separate attachable-detachable nozzle. After completing a job, a user is supposed to remove and ream out the nozzle bore, then recap the tube. Often, the user forgets or fails to adequately clean the nozzle so residual material in the bore hardens, and the container is found to be unusable the next time it is needed so it is discarded. In the "fixed nozzle" variety a cartridge or squeeze tube comes with an attached molded nozzle. Typically a squeeze tube nozzle is covered with an interference-fit cap to be used after the nozzle has been cut. Often the nozzle is cut to so large a diameter that the cap no longer fits properly or at all, or the cap is lost and a replacement cap is unavailable. If either variety is not properly sealed, material therein hardens leaving the cartridge or tube unusable. In the "cap only" variety a squeeze tube typically has a generally circular outlet initially sealed by a membrane covered by a screw-on cap. The membrane must be pierced before material can be squeezed out. The tube is resealed by replacing the cap. If the cap is lost, material in the outlet becomes hardened and the tube becomes unusable.

My U.S. Pat. No. 6,481,597 B1 ("'597"), entitled "Plug Assembly For Removably Resealing A Caulking Tube Nozzle And Method Of Use," which is incorporated herein in its entirety by this reference, discloses a plug having a conically tapering lower portion with contiguous scoring edges each having a leading and a trailing surface which form a sharp circumferential point. The edges have a barb-like shape which presents little resistance going in but is highly resistant to being pulled directly out, rather than being screwed out. By rotationally inserting the plug into the aperture of a caulking or adhesive tube nozzle, at least one point scores the nozzle interior surface to form grooves. The scoring edges are configured so that a small annular air space exists between each pair of contiguous edges and the interior surface after the points penetrate the surface. Meshing of points and grooves in combination with residual caulking material in the nozzle bore, extruded into the air spaces, create an air-tight seal. The nozzle, reopened by unscrewing the plug, can be repetitively resealed because the scoring edges always track within the preformed grooves.

The '597 plug is specialized to sealing caulking tube nozzles and the like because it requires the presence of residual hardenable material in the nozzle bore. What is needed is a multi-purpose plug able to seal a variety of material-dispensing plastic conduits including straw-type tubing, screw-on nozzles, fixed nozzles, and pierced-membrane outlets, without requiring cooperation with residual material.

OBJECTS OF THE INVENTION

In view of the limitations of the '597 plug, it is an object of the present invention to provide a plug capable of removably resealing the outlet aperture of a dispensing conduit made of a soft plastic which is attached or connected to a variety of pressurized cans, cartridges, squeeze tubes and similar containers containing, respectively, a variety of high, medium or low viscosity materials.

Another object of the invention is to provide a plug that is simple to use and inexpensive to buy, even in quantity.

Other objects of the invention will become evident when the following description is considered with the accompanying drawing figures. In the figures and description, numerals indicate the various features of the invention, like numerals referring to like features throughout both the drawings and description.

SUMMARY OF THE INVENTION

These and other objects are achieved by the present invention which in one aspect provides a plug for removably resealing an aperture in a dispensing conduit made of a deformable soft plastic and having an annular end segment proximate to the aperture. The plug includes a conically tapering lower portion having a multiplicity of successively contiguous circumferential scoring edges terminating in a leading scoring edge proximate to a distal end. Each distally successive scoring edge is slightly smaller in circumference. Each scoring edge is canted rearwardly at a first acute angle to a common longitudinal axis, and has a leading edge surface making a second acute angle with respect to an axis orthogonal to the longitudinal axis and a trailing edge surface making a third acute angle with respect to the orthogonal axis. The leading and trailing edge surfaces form a sharp point, and each adjacent pair of scoring edges are separated by a distally tapering circumferential surface. Each point has a common height with respect to the two distally tapering surfaces bounding the point, respectively, proximally and distally. The distal end of the plug lower portion is sized to enable penetration of the conduit aperture by at least the leading scoring edge, thereby contacting and scoring at least one groove in the end segment to a depth equal to the point height.

In another aspect the invention provides a plug for removably resealing an aperture in a dispensing conduit made of a deformable soft plastic and having an annular end segment proximate to the aperture. The plug includes an upper portion having a planar top surface orthogonal to a plurality of convexly arcuate knurls, with each pair of neighboring knurls separated by a concavely arcuate depression. The plug further includes a circumferential skirt having a polygonal plurality of planar edge segments and attached to the plug upper portion. The plug further includes a conically tapering lower portion, attached to the skirt, having a multiplicity of successively contiguous circumferential scoring edges terminating in a leading scoring edge proximate to a distal end with a rounded tip. Each distally successive scoring edge is slightly smaller in circumference. Each scoring edge is canted rearwardly at a first acute angle to a common longitudinal axis, and has a leading edge surface making a second acute angle with respect to an axis orthogonal to the longitudinal axis and a trailing edge surface making a third acute angle with respect to the orthogonal axis. The leading and trailing edge surfaces forming a sharp point, and each adjacent pair of scoring edges are separated by a distally tapering circumferential surface. Each point has a common height with respect to the two distally tapering surfaces bounding the point, respectively, proximally and distally. The distal end of the plug lower portion is sized to enable penetration of the aperture by at least the leading scoring edge, thereby contacting and scoring at least one groove in the end segment to a depth equal to the point height.

In yet another aspect the invention provides a method for removably resealing an aperture in a dispensing conduit made of a deformable soft plastic and having an annular end segment proximate to the aperture. The method includes the step of gripping a handle-like upper portion of a plug which is rigidly attached to a conically tapering lower portion having a multiplicity of successively contiguous circumferential scoring edges terminating in a leading scoring edge proximate to a distal end sized to enable penetration of the aperture by at least the leading scoring edge. Each distally successive scoring edge is slightly smaller in circumference, and each scoring edge is canted rearwardly at a first acute angle to a common longitudinal axis and has a leading edge surface making a second acute angle with respect to an axis orthogonal to the longitudinal axis and a trailing edge surface making a third acute angle with respect to the orthogonal axis. The leading and trailing edge surfaces form a sharp point, and each adjacent pair of scoring edges are separated by a distally tapering circumferential surface. Each point has a common height with respect to the two distally tapering surfaces bounding the point, respectively, proximally and distally. The method further includes the steps of: penetrating the aperture with at least the leading scoring edge, thereby contacting and scoring at least one groove in the end segment to a depth equal to the point height; and screwing in the plug so as to penetrate further into the conduit bore, thereby scoring additional grooves in the end segment, to a depth equal to the point height, as additional scoring edge points contact the end segment.

A more complete understanding of the present invention and other objects, aspects and advantages thereof will be gained from a consideration of the following description of the preferred embodiment read in conjunction with the accompanying drawings provided herein.

DESCRIPTION OF THE PREFERRED EMBODIMENT

Figure 1:
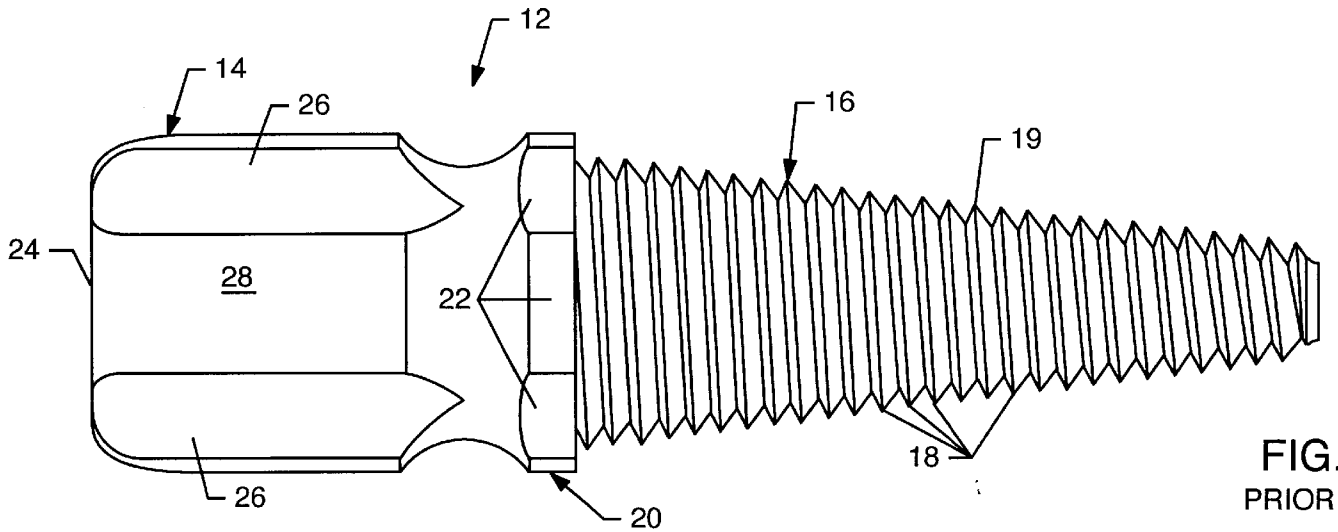
FIG. 1 PRIOR ART
FIG. 1 is an elevational view of the '597 plug showing the configuration of the scoring edges.

While the present invention is open to various modifications and alternative constructions, the preferred embodiment shown in the drawings will be described herein in detail. It is to be understood, however, there is no intention to limit the invention to the particular form disclosed. On the contrary, it is intended that the invention cover all modifications, equivalences and alternative constructions falling within the spirit and scope of the invention as expressed in the appended claims.

Where used herein, the word "attached" means that the two parts referred to are either fabricated in a single piece, preferably by molding of a thermoplastic, or bonded, glued or otherwise permanently joined together. Where used herein, the word "connected" means that the two parts referred to are easily joined and disassembled.

Referring to FIG. 1, a plug 12 according to the '597 invention includes a knurled upper portion 14, and a conically tapering lower portion 16 with a multiplicity of successively contiguous circumferential scoring edges 18, each having a sharp "knife edge" point 19. Disposed between and rigidly attached to upper and lower portions 14, 16 is a circumferential skirt 20 having a polygonal plurality of generally planar edge segments 22 which prevent the plug from rolling when placed horizontal on a flat surface. Upper portion 14 has a generally planar top surface 24 generally orthogonal to a plurality of convexly arcuate knurls 26, with each pair of neighboring knurls separated by a concavely arcuate depression 28. Flat surface 24 allows the plug to be placed vertically on a flat surface without tipping over. Upper portion 14 is of greater mass than lower portion 16 to keep the plug lying horizontal on a flat surface, even with residual caulking or adhesive material caked on the scoring edges. As shown in FIG. 5 of the '597 patent, when plug 12 is rotationally inserted within the dispensing aperture of a distally tapering nozzle made of a soft plastic, at least one edge partially scores the nozzle interior surface, creating a groove. Although the edge points 19 penetrate the surface, a small gap exists between each adjacent pair of penetrating edges, which meet in a "V"-shaped vertex, and the surface. Such gaps, which reform when the plug after having been rotationally removed is reinserted, fill with residual material to create an air-tight seal.

Figure 2:
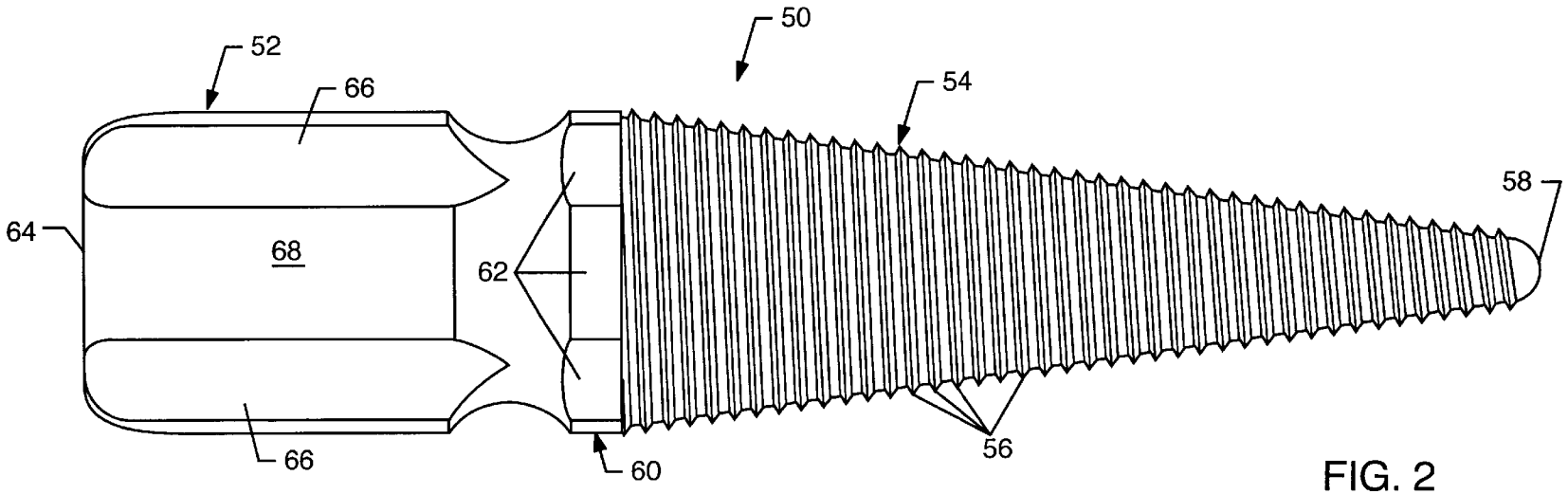
FIG. 2 is an elevational view of a plug according to the present invention, showing the configuration of the scoring edges.

FIG. 2 shows a plug 50 according to the present invention which superficially appears very similar to plug 12. Plug 50 includes a knurled upper portion 52, a conically tapering lower portion 54 with a multiplicity of successively contiguous circumferential scoring edges 56, and a rounded tip 58. Disposed between and rigidly attached to upper and lower portions 52, 54 is a circumferential skirt 60 having a polygonal plurality of generally planar edge segments 62 which prevent the plug from rolling when placed horizontal on a flat surface. Upper portion 52 has a generally planar top surface 64 generally orthogonal to a plurality of convexly arcuate knurls 66, with each pair of neighboring knurls separated by a concavely arcuate depression 68. Flat surface 64 allows the plug to be placed vertically on a flat surface without tipping over. Upper portion 52 is of greater mass than lower portion 54 to keep the plug lying horizontal on a flat surface.

Figure 2A:
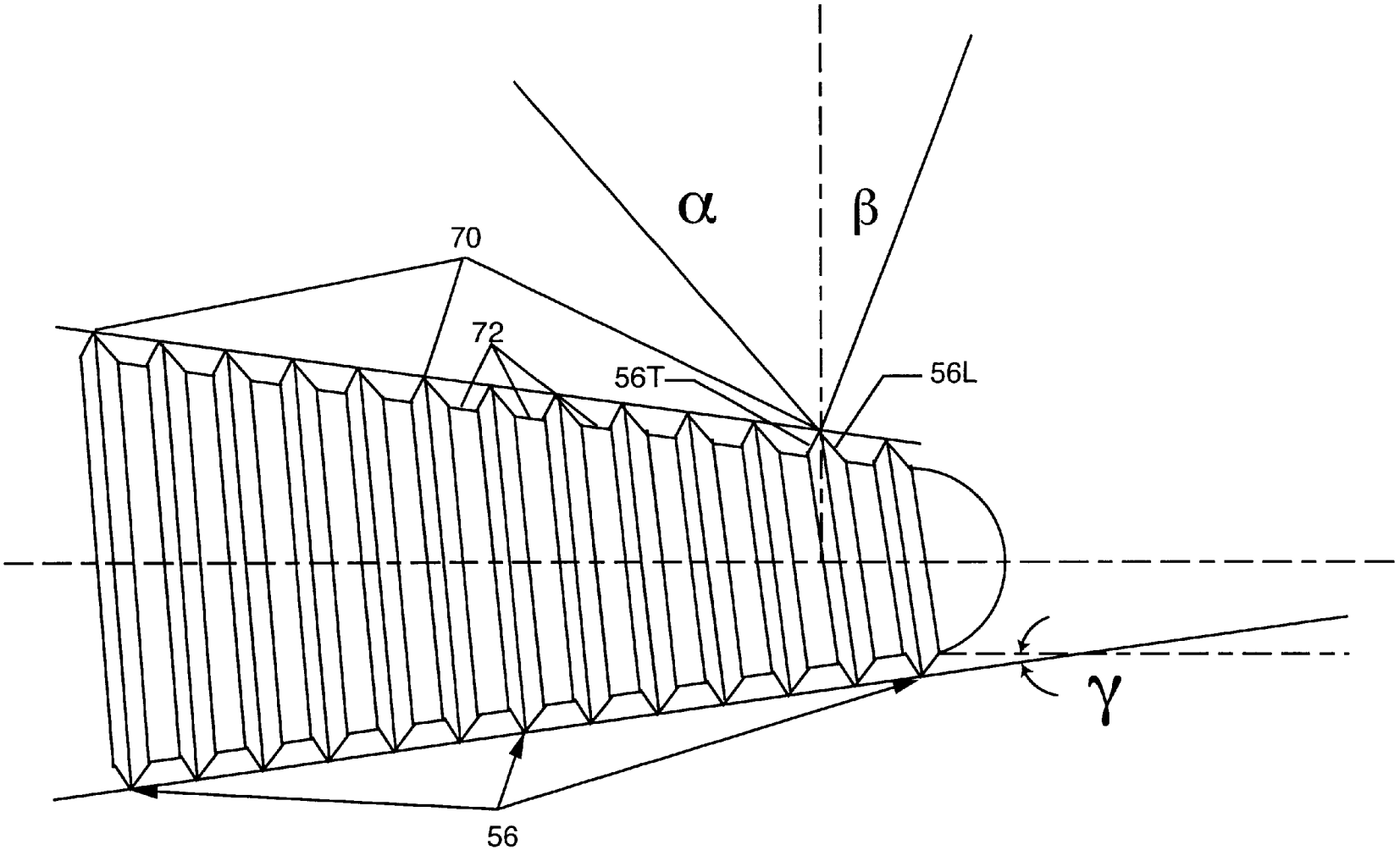
FIG. 2A shows the angular configuration common to each of the FIG. 2 scoring edges.

Referring to FIG. 2A, as in the '597 plug, each scoring edge 56 is canted rearwardly at an acute angle $\gamma$ to a common longitudinal axis, and has a leading edge surface 56L making an acute angle $\alpha$ with respect to an axis orthogonal to the longitudinal axis, and a trailing edge surface 56T making an acute angle $\beta$ with respect to the orthogonal axis. Preferably, angle $\alpha$ is in a range between about 30 degrees to about 40 degrees, angle $\beta$ is in a range between about 15 degrees to about 25 degrees, and angle $\gamma$ is in a range from about 5 degrees to about 12 degrees. Surfaces 56L and 56T come to a sharp point 70, forming a "knife edge." Each distally successive scoring edge is slightly smaller in circumference so that the envelope encompassing the totality of scoring edges is at the angle $\gamma$ with respect to an axis parallel to the longitudinal axis. In plug 50 the leading edge surface and trailing edge surface of each adjacent pair of scoring edges are separated by a distally tapering circumferential surface 72 which appears in FIG. 2A as a line segment. This is in contrast with the leading and trailing edge surfaces of adjacent scoring edges in plug 12 which join to form a "V"-shaped circumferential vertex.

Figure 3:
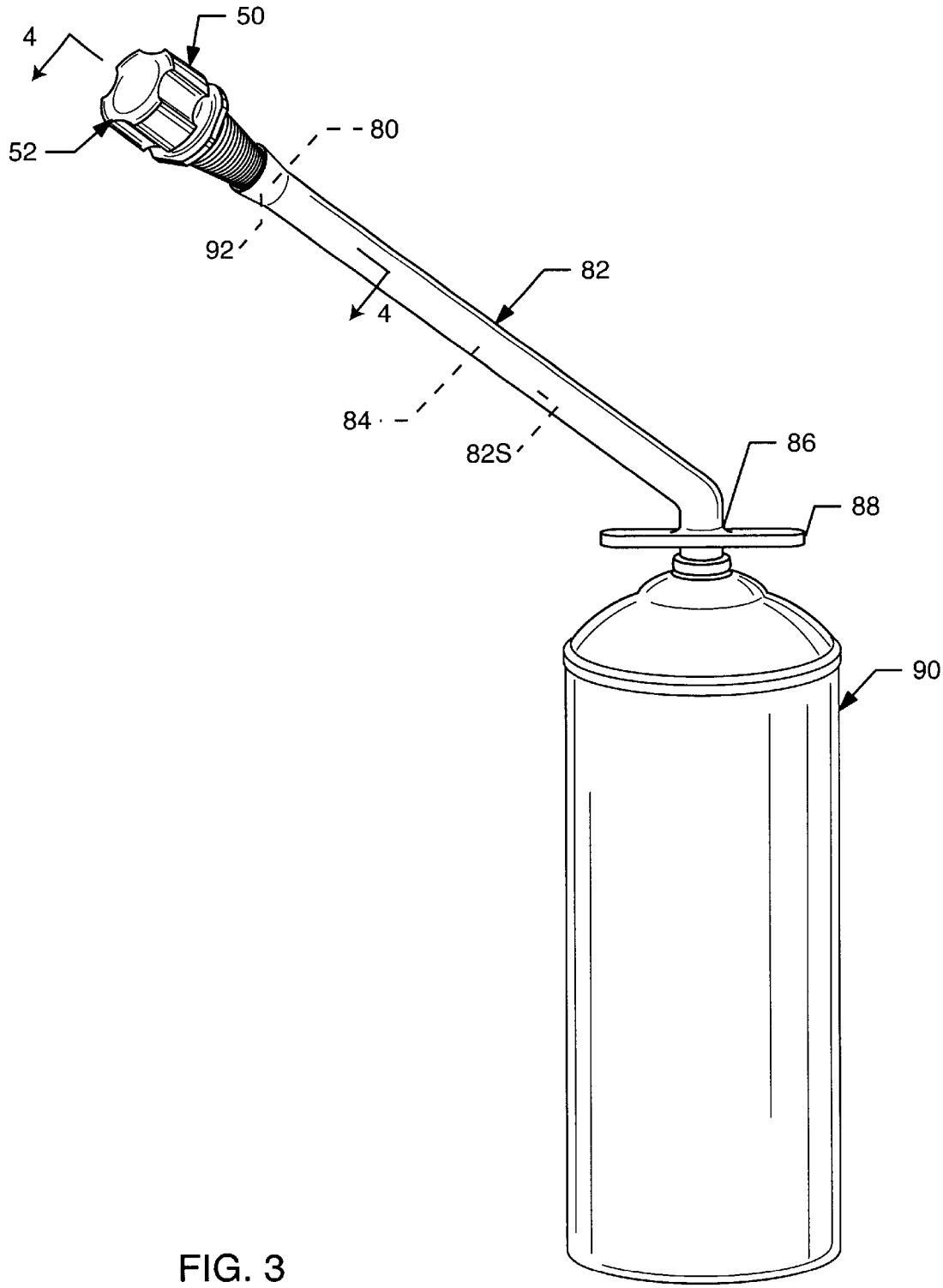
FIG. 3 is a perspective view of the FIG. 2 plug inserted into the distal aperture of a straw-like dispensing tube of a pressurized can.
Figure 4:
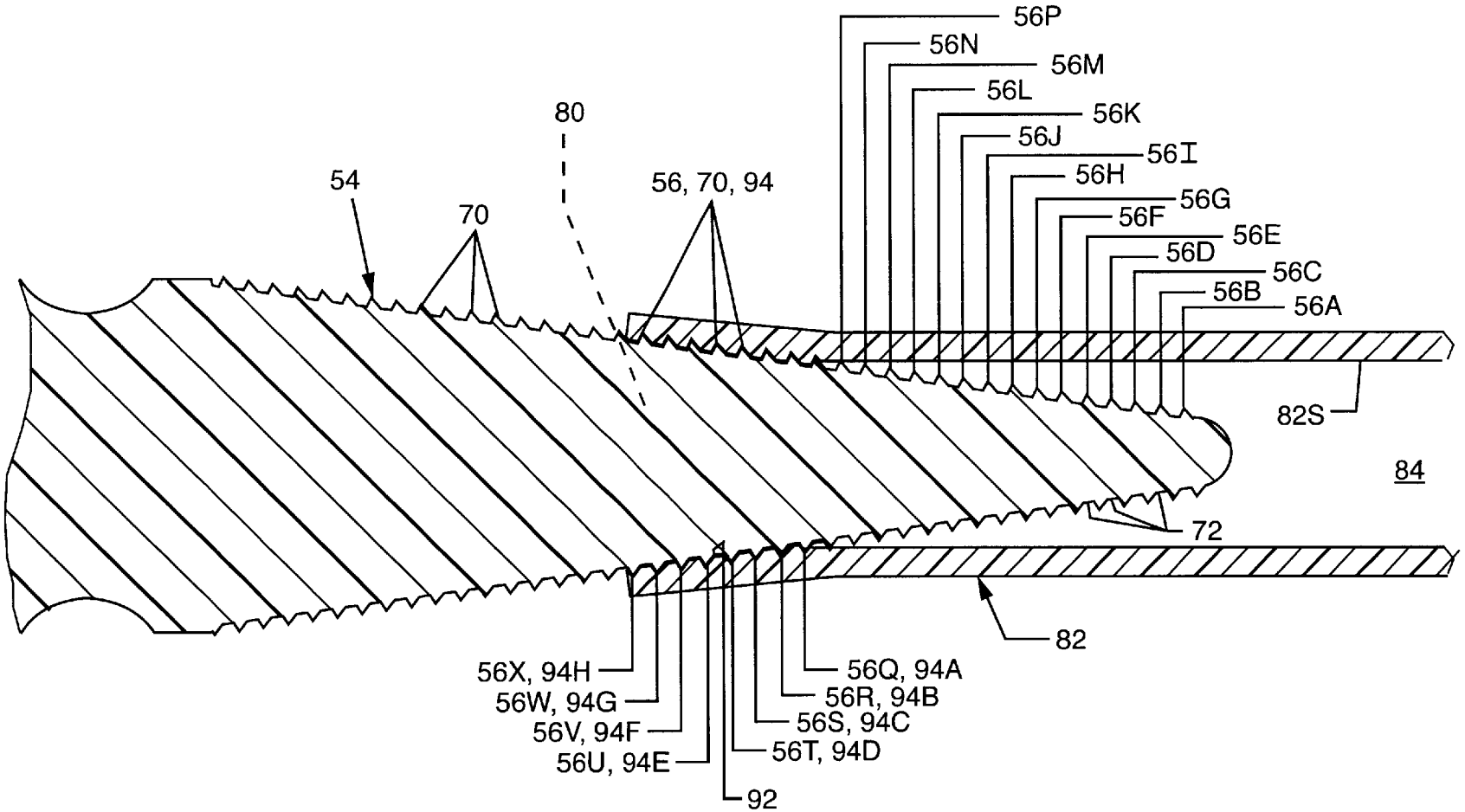
FIG. 4 is a sectional view taken along line 4—4 in FIG. 3 showing grooves scored into the inner surface of the tube end by a plurality of scoring edges, and the absence of air gaps between the edges and surface.

Referring to FIGS. 3 and 4, plug 50 is rotationally inserted within a generally circular dispensing aperture 80 of a straw-like tube 82 made of a soft plastic and having an axially symmetric bore 84 therethrough determined by a generally cylindrical interior surface 82S. Tube 82 is connected at its proximal end 86 to a dispensing mechanism 88 of a can 90 containing a foam sealant. It should be understood that the plastic conduit, viz., a straw-like tube, the container, viz., a pressurized can, and the material dispensed, viz., foam sealant, are chosen here by way of example; plug 50 is equally applicable to sealing a tapering nozzle or a "cap only" aperture. The screwdriver handle-like conformation of upper portion 52 enables a user to tightly grip the plug and firmly insert it through the aperture 80, which initially may be smaller in circumference than the leading (smallest circumference) scoring edge, thus deforming, viz., expanding, generally cylindrical, annular end segment 92 of surface 82S contacted as the leading or leading and second scoring edges penetrate. The plug is then further screwed in one full revolution in a clockwise direction, penetrating further into the nozzle and creating grooves 94 in end segment 92 as the points of additional scoring edges contact the end segment. The points score rather than carve the interior surface since no plastic material is excised. As in the '597 patent, the scoring edges 56 have a barb-like shape which presents little resistance going into the tube but is highly resistant to accidentally being pulled directly out, rather than being screwed out (counterclockwise) to remove the plug. When the plug is reinserted and screwed in (clockwise) the points 70 track within the pre-existing grooves. In FIG. 4, the relative dimensions of aperture 80 and lower portion 54 are such that the first fifteen scoring edges 56A, 56B, 56C, 56D, 56E, 56F, 56G, 56H, 56I, 56J, 56K, 56L, 56M, 56N, 56P have freely entered bore 84 before the sixteenth edge 56Q begins scoring the interior surface, followed by edges 56R, 56S, 56T, 56U, 56V, 56W, 56X, thereby forming grooves 94A, 94B, 94C, 94D, 94E, 94F, 94G, 94H. (For clarity in FIG. 4, the number of edges in lower portion 54, the number of edges scoring end segment 92, and the number of grooves created are exaggerated.)

As shown in FIG. 4, because the common height of points 70, which preferably is at least 0.003-inch, equals the common depth of grooves 94 and the common taper of surfaces 72 is determined by the taper of lower portion 54, there is no gap between each point 70 and scored groove 94. Thus, the plug 50 is self-sealing. That is, an air-tight seal is formed without the need of any residual material trapped between lower portion 54 and end segment 92. For sealing a nozzle dispensing caulking or adhesive, plug 50 provides an advantage vis-a-vis plug 12 because it eliminates "wicking" occurring when a sealant cures so it migrates through the air spaces, eventually reaching the nozzle aperture. Another advantage is that the chance of plug 50 being unintentionally glued into a nozzle is virtually eliminated, as the edges "squeeze" residual material out of end segment 92, except for a micro-thin layer.

For cartridges and squeeze tubes having a tapering nozzle, plug 50 should be screwed in 1 to 3 revolutions or until the plug is secure. Over-tightening can cause nozzle damage and make plug removal difficult after storage. For "cap-only" squeeze tubes, plug 50 should be screwed in at least three revolutions. Stores frequently get requests for replacement caps for these tubes. Because of the wide variety of sizes and thread pitches among the many brands and products available in squeeze tubes, providing a replacement cap generally is not feasible. Plug 50 solves the cap replacement problem by rendering such differences irrelevant.

Preferably, plug 50 is fabricated from a thermoplastic such as glass-filled polypropylene or polyurethane containing about 10 to about 50 percent glass fiber material. Most preferably, the glass fiber material is in a range from about 15 to about 25 percent. Compared to glass-filled NYLON™, glass-filled polypropylene and polyurethane are less expensive, more resistant to adhesion, and totally resistant to chemicals and staining. The glass fiber additive maintains sharpness of the points and provides the hardness and strength required to score end segment 92.

What is claimed is:

1. A plug for removably resealing an aperture of a preselected circumference in a dispensing conduit of a container of material, the conduit made of a deformable soft plastic and having an axially symmetric bore therethrough determined by an interior surface having a generally annular end segment proximate to the aperture, the plug comprising:

an upper portion rigidly attached to a conically tapering lower portion, the lower portion having a multiplicity of successively contiguous circumferential scoring edges terminating in a leading scoring edge proximate to a distal end having a preselected circumference, each distally successive scoring edge slightly smaller in circumference, each scoring edge canted rearwardly at a preselected first acute angle to a common longitudinal axis, each scoring edge having a leading edge surface making a preselected second acute angle with respect to an axis orthogonal to the longitudinal axis and a trailing edge surface making a preselected third acute angle with respect to said orthogonal axis, the leading and trailing edge surfaces forming a sharp point, each adjacent pair of scoring edges separated by a distally tapering circumferential surface, each point having a common preselected height with respect to the two distally tapering surfaces bounding the point, respectively, proximally and distally; and the circumference of the distal end of the plug lower portion sized to enable penetration of the aperture by at least the leading scoring edge, thereby contacting and scoring at least one groove to a preselected depth in said end segment.

2. The plug of claim 1, wherein:

said first acute angle is in a range from about 5 degrees to about 12 degrees;

said second acute angle is in a range from about 30 degrees to about 40 degrees;

said third acute angle is in a range from about 15 degrees to about 25 degrees; and said common height of each said point is at least 0.003-inch and equals a common depth of each said groove.

3. The plug of claim 2, wherein the plug is fabricated from a glass-filled polypropylene containing about 10 to about 50 percent glass fiber material.

4. The plug of claim 2, wherein the plug is fabricated from a glass-filled polyurethane containing about 10 to about 50 percent glass fiber material.

5. A plug for removably resealing an aperture of a preselected circumference in a dispensing conduit of a container of material, the conduit made of a deformable soft plastic and having an axially symmetric bore therethrough determined by an interior surface having a generally annular end segment proximate to the aperture, the plug comprising:

an upper portion having a generally planar top surface generally orthogonal to a plurality of convexly arcuate knuris, each pair of neighboring knurls separated by a concavely arcuate depression;

a circumferential skirt having a polygonal plurality of generally planar edge segments, the skirt rigidly attached to the plug upper portion;

a conically tapering lower portion, rigidly attached to the skirt, having a multiplicity of successively contiguous circumferential scoring edges terminating in a leading scoring edge proximate to a distal end with a rounded tip having a preselected circumference, each distally successive scoring edge slightly smaller in circumference, each scoring edge canted rearwardly at a preselected first acute angle to a common longitudinal axis, each scoring edge having a leading edge surface making a preselected second acute angle with respect to an axis orthogonal to the longitudinal axis and a trailing edge surface making a preselected third acute angle with respect to said orthogonal axis, the leading and trailing edge surfaces forming a sharp point, each adjacent pair of scoring edges separated by a distally tapering circumferential surface, each point having a common preselected height with respect to the two distally tapering surfaces bounding the point, respectively, proximally and distally; and the circumference of the distal end of the plug lower portion sized to enable penetration of the aperture by at least the leading scoring edge, thereby contacting and scoring at least one groove to a preselected depth in said end segment.

6. The plug of claim 5, wherein:

said first acute angle is in a range from about 5 degrees to about 12 degrees;

said second acute angle is in a range from about 30 degrees to about 40 degrees;

said third acute angle is in a range from about 15 degrees to about 25 degrees; and said common height of each said point is at least 0.003-inch and equals a common depth of each said groove.

7. The plug of claim 6, wherein the plug is fabricated from a glass-filled polypropylene containing about 10 to about 50 percent glass fiber material.

8. The plug of claim 6, wherein the plug is fabricated from a glass-filled polyurethane containing about 10 to about 50 percent glass fiber material.

9. A method for removably resealing an aperture of a preselected circumference in a dispensing conduit of a container of material, the conduit made of a deformable soft plastic and having an axially symmetric bore therethrough determined by an interior surface having a generally annular end segment proximate to the aperture, comprising the steps of:

gripping a handle-like upper portion of a plug, the upper portion rigidly attached to a conically tapering lower portion, the lower portion having a multiplicity of successively contiguous circumferential scoring edges terminating in a leading scoring edge proximate to a distal end having a preselected circumference, each distally successive scoring edge slightly smaller in circumference, each scoring edge canted rearwardly at a preselected first acute angle to a common longitudinal axis, each scoring edge having a leading edge surface making a preselected second acute angle with respect to an axis orthogonal to the longitudinal axis and a trailing edge surface making a preselected third acute angle with respect to said orthogonal axis, the leading and trailing edge surfaces forming a sharp point, each adjacent pair of scoring edges separated by a distally tapering circumferential surface, each point having a common preselected height with respect to the two distally tapering surfaces bounding the point, respectively, proximally and distally, the circumference of the distal end of the plug lower portion sized to enable penetration of the aperture by at least the leading scoring edge;

penetrating the aperture with at least the leading scoring edge, thereby contacting and scoring at least one groove in said end segment to a depth equal to said point height; and screwing in the plug so as to penetrate further into the conduit bore, thereby scoring additional grooves in said end segment, to a depth equal to said point height, as additional scoring edge points contact the end segment, each said groove having a depth equal to said point height.

10. The method of claim 9, wherein:

said first acute angle is in a range from about 5 degrees to about 12 degrees;

said second acute angle is in a range from about 30 degrees to about 40 degrees;

said third acute angle is in a range from about 15 degrees to about 25 degrees; and said point height is at least 0.003-inch.

11. The plug of claim 10, wherein the plug is fabricated from a glass-filled polypropylene containing about 10 to about 50 percent glass fiber material.

12. The plug of claim 10, wherein the plug is fabricated from a glass-filled polyurethane containing about 10 to about 50 percent glass fiber material.

* * * * *